United States Patent [19]

Benson, III

[11] 4,200,293

[45] Apr. 29, 1980

[54] SPACE GAME

[76] Inventor: Harry Benson, III, 4824 W. 133rd St., Hawthorne, Calif. 90250

[21] Appl. No.: 912,372

[22] Filed: Jun. 5, 1978

[51] Int. Cl.[2] ..... A63F 3/02

[52] U.S. Cl. ..... 273/260; 273/288; 273/262

[58] Field of Search ..... 273/260, 261, 258, 288, 273/289, 290, 291, 262

[56] References Cited

U.S. PATENT DOCUMENTS

| | | | |
|---|---|---|---|
| 526,373 | 9/1894 | Boyer | 273/258 |
| 621,799 | 3/1899 | Degges | 273/290 X |
| 1,463,871 | 8/1923 | Chisolm | 273/246 |
| 3,462,152 | 8/1969 | Royston | 273/246 |
| 3,844,563 | 10/1974 | Isaac | 273/260 |
| 3,869,124 | 3/1975 | Stein et al. | 273/260 X |
| 3,989,253 | 11/1976 | Schifman | 273/260 |
| 4,083,564 | 4/1978 | Matsumoto | 273/239 |
| 4,093,237 | 6/1978 | Weiss | 273/260 |
| 4,157,184 | 6/1979 | Recard, Jr. | 273/253 |

FOREIGN PATENT DOCUMENTS

| | | | |
|---|---|---|---|
| 2269985 | 12/1975 | France | 273/288 |
| 112018 | 10/1925 | Switzerland | 273/290 |
| 24891 | of 1895 | United Kingdom | 273/262 |
| 14317 | of 1902 | United Kingdom | 273/262 |
| 7408 | of 1903 | United Kingdom | 273/262 |

*Primary Examiner*—Richard C. Pinkham

*Assistant Examiner*—Scott L. Brown

*Attorney, Agent, or Firm*—Spensley, Horn, Jubas & Lubitz

[57] ABSTRACT

This invention relates to games, and more particularly, to a chess-like board game. The game comprises, in the first embodiment, a gameboard having disposed thereon a playing field including a generally square area of individual checker-like squares forming said playing field. The squares form increments of travel for uniquely configured marker members. Each player is given a set of marker members, and each set has identification means for identifying the marker members of that set which belong to a particular player. Each marker member has eight sides with means disposed adjacent each side for indicating the number of squares that marker member may move in a predetermined direction. The game also includes chance means which is operable by each player for identifying the square upon which each of the marker members which belong to each player is placed at the inception of the game.

In another embodiment of the present invention, the gameboard is configured so as to have a honeycomb-like configuration, and the marker members which are used by each player, are hexagonal in shape.

By the use of the game of the present invention, a strategy and method of playing similar to chess is achieved. The complexity and number of different pieces used in chess, however, is substantially eliminated.

4 Claims, 5 Drawing Figures

Fig. 3
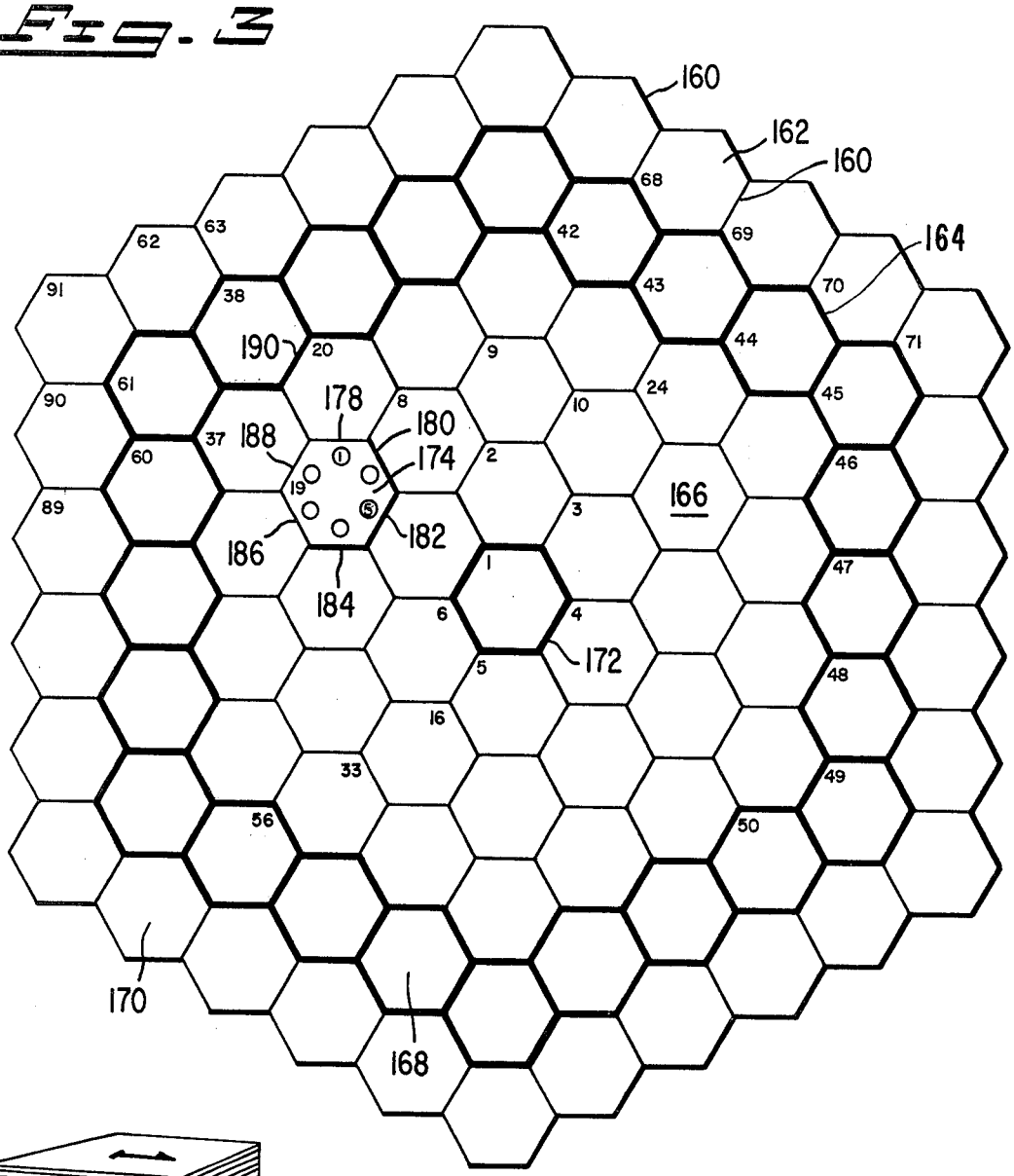
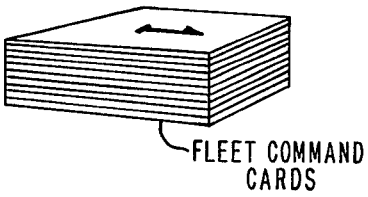
Fig. 5
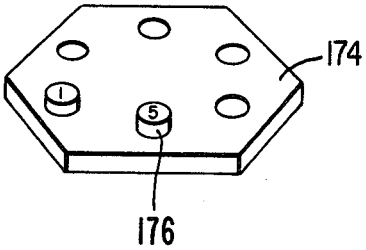
Fig. 4

SPACE GAME

BACKGROUND OF THE INVENTION

1. Field of the Invention

The present invention relates to board games, and more particularly, to a chess-like board game.

2. Prior Art

Board games are extremely well known in the art. Perhaps one of the most well known board games is chess. In chess, a number of different pieces are each assigned different moving ability, with the Queen being the strongest player in the game. The pieces are arranged on the well known checkerboard, with each "army" facing one another. The object of the game is to capture the opponent's King. While chess is an extremely popular game, it suffers from a number of shortcomings, perhaps the most obvious is the fact that the game is rather complicated and requires many years of practice before the game can be truly mastered. In addition, the game requires a number of different playing pieces, i.e., a King, Queen, Bishops, Knights, Rooks and Pawns.

On the other hand, the principle behind chess, competing one army against another, has captured the "gamesmanship" of a large number of people. Based on this principle, a proliferation of board games has evolved. Representatives of similar games can be found in a large number of patents. For example, reference is made to U.S. Pat. Nos. 3,999,760; 3,998,463; and 4,049,274. While each of these patents describes various board games, the game of the present invention enables one to evolve a strategy like chess, but utilizes different playing members in such a manner that it is substantially easier for the game to be learned. However, since the game of the present invention lends itself to the development of strategies, and the like, it can also be played by very sophisticated players, thus substantially eliminating the possibility of winning the game by luck, as is the case in many prior art games.

BRIEF SUMMARY OF THE INVENTION

The present invention relates to board games, and more particularly, in one embodiment, to a gameboard having disposed thereon a playing field including a generally square area of individual checker-like squares forming the playing field. The squares include means for identifying each such square. The squares are arranged and configured so as to form increments of travel for the playing marker members. Two or three sets of marker members, with each set having an identifying means such as a color, are used in playing the game of the present invention. In the first embodiment, the marker members have eight sides with each side being provided with indentations for receiving indicator pegs or like indicator members indicating the number of squares the associated marker member may move in a given direction. The game also includes means for identifying the placement of each marker member on a specific square at the inception of the game.

In a second embodiment of the present invention, the gameboard is comprised of hexagonal-shaped spaces, the marker members having a hexagonal configuration as well. On each side of the marker member, means are included for indicating the number of spaces the marker member may move in a given direction.

In playing the game of the present invention, the object is to capture the marker members of the opposing team or to weaken opposing marker members by a maneuver which takes increments of their range and adds to one's own marker members the range obtained.

BRIEF DESCRIPTION OF THE DRAWINGS

FIG. 3 is a top plan view of the gameboard of the second embodiment of the present invention; and FIG. 4 is a perspective view showing the marker member used in connection with the second embodiment of the present invention.

FIG. 5 is a perspective view showing the means for identifying the spaces on the gameboard of either the first or second embodiment.

DETAILED DESCRIPTION OF THE INVENTION

Figure 1:
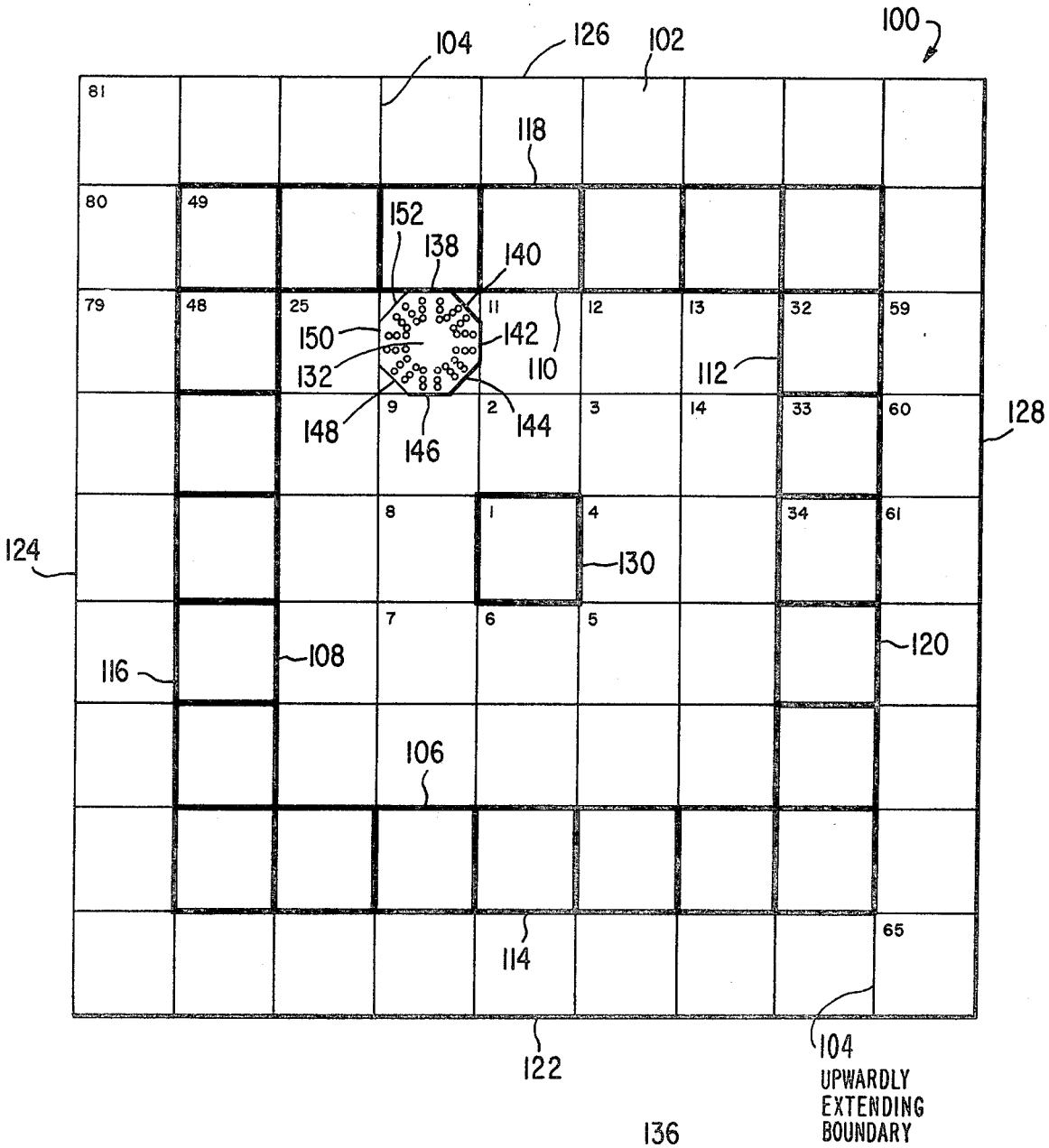
FIG. 1 is a top plan view of the gameboard of the first embodiment of the present invention.

As indicated herein, the present invention relates to a chess-like space board game. While the game can be adapted to other motifs, it is believed that a game based on "outerspace" would appeal to a wider number of people than a game based on kings, queens and castles. For ease of identification only, the first embodiment is referred herein as "NEBULA" and the second embodiment is referred to herein as "NOVA". The basic rules, however, are the same for each embodiment. The marker members as further described herein, for identification only, are referred to as "starships" and the objective of the game is to capture or disarm the starships of the opposing player or players. In order to achieve this result, each starship has assigned thereto, its own individual range or "force" at the inception of the game. Starships may therefore capture opposing starships outright, a "kill", and thereby remove them from the board. In another situation, the force, which is located adjacent to each side of a starship, may be transferred to an opposing starship in a move which is described as a "dock and sieze" maneuver, referred to herein as "bumping". The movement of a starship along the gameboard may also be "warped", that is, the rotational orientation and direction of movement of a starship may change its direction within a move. In addition, a starship may also remain stationary discharging only the force of one of its sides in a sacrificial move or gambit called "committing the force". Finally, a starship may also "rotate", that is, position its array of forces in a new direction.

The game is won when the opposition surrenders or when all opposing starships have been removed from the board. A draw occurs by agreement of the players or after a lone starship survives for more than fifty moves. The game begins with the design of the starships. Numerical values are assigned to each side of each starship indicating the number of spaces it may move in a direction which is perpendicular to the associated side. This range can be applied in any configuration the player desires, except that one may not exceed six spaces of force in any one direction, and the total number of moves all the starships of each player may make is distributed such that it is fifteen times the number of starships the player has at the beginning of the game. Thus, each side of each starship may be assigned a value of 0, 1, 2, 3, 4, 5, or 6. Thus, it is possible to have a maximum of 48 points on a starship in the first embodiment of the present invention, and 36 points on a starship in the second embodiment of the present invention. It would be unwise to use so many of the points on a single starship as said starship would still be vulnerable to attack and the remaining starships of the player would have significantly less force and therefore be weak and vulnerable to attackers.

Outright capture of an opposing starship is accomplished by moving one's starship into the space occupied by opposing member's starships, thus removing it from the board. In this manner, capture is similar to that of a chess piece. However, in the game of the present invention, each player may only move the number of spaces, or fewer, which are indicated on the leading side of the starship being moved. When such a capture is made, none of the force of the captured starship is transferred to the winning starship. However, when a starship is vulnerable to such a capture and for one reason or another an outright capture is not advisable, i.e., perhaps the starship is well protected and would be a bad trade, it is then possible to move into the space next to the vulnerable starship and "bump" or "dock and sieze". In this maneuver, the force is removed from the side of the attacked starship adjacent to the aggressor and applied to the attacking starships adjacent side. Any points of force left after that side has its maximum force of six, are applied to an adjoining side which has space available.

"Committing the force" is a move in which only the force from one side of the starship is moved. This is a sacrificial move. The force on one side of a starship may move to any of the spaces that the whole starship could have gone to in that direction. It may not capture or dock and sieze on this move, but on the following move its range can be in any direction. It must capture a whole starship on its second move. It may not bump, nor may opposing starships bump it. It may be captured and removed from the board to prevent the aggressive second move. In any case, it is removed from the board after the second move.

The peripheral spaces in the game being played are "warp spaces" and the center space is an optional warp space. When a starship runs into one of these warp spaces and it still has more range left, it may continue to move by going in a direction which forms an acute angle with the immediately preceding part of its move. For example, in the first embodiment it is 45° and in the second embodiment it would be 60°. When warping, a mandatory warp rotation occurs as the starship traverses the warp space. In this manner, the side whose force is being used continues to be in the forefront of the marker member's direction of travel. Warp rotation must be done with the above-described angle. If a piece stops on a warp space, it may not rotate unless it qualifies for "optional rotation". Optional rotation can be done only when a starship moves one-half or less of its range of force in a given direction. The starship may rotate to any position desired. Optional rotation also contrasts with warp rotation in that it always occurs as the last part of the move. Optional rotation may not be done on a capturing move. In the case of the optional warp space in the center of the board, a starship must warp with the mandatory warp rotation, or if it elects to go straight or to stop on the space, it must qualify by the above-noted optional rotation rule to rotate.

After the force has been assigned to all starships, each player, staring with the least skillful player, draws an induction point from "fleet command" and places one of its starships on the space indicated by such card in any rotation he desires. Fleet command as used herein is a means for generating any of the numbers corresponding to the spaces of playing area used. For example, a stack of cards, with each card having a number disposed on it corresponding to a space on the gameboard. FIG. 5 shows such a stack of cards. After the players have alternately placed all of their starships on the board, one at a time, the player who placed the first starship on the board moves first. On the first three moves of each side, no capturing or bumping is allowed. A stalemate occurs when each side agrees that no one has the power to entirely eliminate the opposition, or after fifty successful defensive moves by a lone starship.

Handicapping the better player to create an even game between players of different skills can be done by the game of the present invention with great precision. For example, the better player simply reduces his supply of force by one or more points at the beginning of the game.

The game also can be recorded by the use of a simple notation which lends itself to tournament play or stakes play. In the game of the first embodiment of the present invention, the placement moves of a typical game can be noted as follows:

(Player A) 16/212343 (Player B) 11/332322
(Player C) none

The number to the left of the slash indicates the space on which the starship is placed. The number to the right of the slash indicates the array of force and its direction starting from a given location on the playing board and going clockwise. When the starship moves from one space to another, but no rotation or warping is done, only the starting space and final space need be given (i.e., 4/16). Use the prefix CF for committing the force, DS and the new numerical pattern for dock and sieze.

Indicated in TABLE 1 are the various game versions, players, points per player, and spaces of board used in the various embodiments of the present invention. The figures listed are meant as guidelines and players may adjust one or more by pregame agreement among themselves.

TABLE 1

| Game Version | Players | Starships per Player | Points per Player | Spaces of Board Used | Warp Spaces (Space 1-Optional all games) |
|---|---|---|---|---|---|
| Nebula | 2 | 11 | 165 | All 81 | 1 & 50–81 |
| full board | 3 | 7 | 105 | All 81 | 1 & 50–81 |
| Nebula | 2 | 6 | 90 | 1–49 | 1 & 26–49 |
| partial board | 3 | 4 | 60 | 1–49 | 1 & 26–49 |
| Nebula | 2 | 3 | 45 | 1–25 | 1 & 10–25 |
| partial board | 3 | 2 | 30 | 1–25 | 1 & 10–25 |
| Nova | 2 | 11 | 165 | All 91 | 1 & 62–91 |
| full board | 3 | 7 | 105 | All 91 | 1 & 62–91 |
| Nova | 2 | 7 | 105 | 1–61 | 1 & 38–61 |
| partial board | 3 | 5 | 75 | 1–61 | 1 & 38–61 |
| Nova | 2 | 4 | 60 | 1–37 | 1 & 20–37 |
| partial board | 3 | 3 | 45 | 1–37 | 1 & 20–37 |

Reference is now made to FIGS. 1 through 4 for further explanation of the game of the present invention.

Referring first to FIG. 1, the first embodiment of the present invention is illustrated. In the first embodiment of the present invention, a board 100 having a generally rectangular configuration is substantially similar to that of a checkerboard, with the difference being that the number of squares 102 need not be the same. In order to prevent a given marker member (hereinafter described) from easily sliding off its square 102 or out of its rotational position, a boundary 104 may be provided which divides the board up into a predetermined number of squares 102. Such boundary could be, for example, upwardly extending members which are intersected so as to form the individual squares. Other boundary members, such as pegs, or the like, are also within the scope of the present invention.

As discussed hereinabove, the game can be played on a beginner intermediate, or advanced level. At the beginner level, only the inner square formed by sections 106, 108, 110 and 112 are used. In this configuration, 25 squares, Nos. 1–25, in a five by five square configuration are utilized. In the intermediate configuration, sections 114, 116, 118 and 120 are utilized, i.e., Nos. 1–49, in a seven by seven square configuration. In the advanced configuration, the entire board 100 formed by sections 122, 124, 126 and 128 are utilized, i.e., Nos. 1–81, in a nine by nine square configuration. Of course, the board can be expanded even larger than that illustrated in FIG. 1, and more marker members could be used in proportion to the larger playing area.

As discussed hereinabove, the game can be played with an inner square 130 which forms a location on which the various marker members 132 can be "warped" so as to change their direction. Thus, when a member 132 enters the inner square 130, it could move at an acute angle with respect to its entrance direction.

Figure 2:
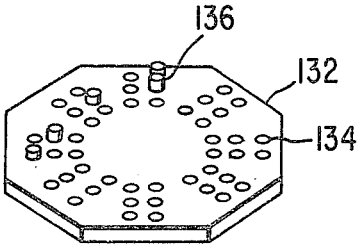
FIG. 2 is a perspective view of the marker member used in connection with the gameboard of the first embodiment of the present invention.

Referring now to FIG. 2, the marker member 132 is illustrated. In one embodiment, the marker member 132 has a plurality of holes 134 adjacent each of the eight sides, sides 138, 140 . . . 152. Preferably, a total of six holes are formed adjacent each of the eight sides of the member 132. Pegs 136 are pushed into each of the holes adjacent the side which govern the number of squares the member 132 may travel in a predetermined direction. For example, referring back to FIG. 1, one can see that marker member 132 has been disposed on the board 100 on the square indicated as square 10. Certain squares, of course, would be numbered such that a specific square could easily be identified. In such a configuration, assume that marker member 132 is going to be moved towards the left of the board and assume sufficient range in that direction. It, and more specifically side 150, would proceed until side 150 impinged upon section 108 at which time the marker member 132 could either move at an angle of 45° with respect to its beginning line of travel or stop. Note that side 150 must relate to the forefront of the new direction of travel. If marker member 132 reached section 108 using one-half its range or less, it could stop and still rotate on that square (optional rotation).

Referring now to FIG. 3, the second embodiment of the present invention is illustrated. In the second embodiment of the present invention, the board 160 is formed by a plurality of hexagonally-shaped spaces 162 forming a honeycomb-like configuration. Again, a boundary 164 may be positioned between each of the various spaced 162 so as to separate the locations and position the various marker members 174 therein and to prevent accidental rotation. In the second embodiment of the present invention, there is an inner playing field 166 having 37 spaces, Nos. 1–37, an intermediate playing field 168 having 61 spaces, Nos. 1–61, and an outer playing field 170 having 91 spaces, Nos. 1–91. Again, there is also an inner location or space 172 which can be used to increase the action of the game by permitting players to change direction when traversing space 172 and thereby change direction of travel and rotation of the marker member 174.

Referring now to FIG. 4, one can see that in the second embodiment of the present invention, peg member 176 indicating the number of spaces the marker member 174 may be moved is selectively disposed adjacent each side. It is to be understood, however, that other configurations for indicating the number of moves may be used in connection with either marker 132 or 174. For example, an indentation can be formed adjacent the various sides and a numbered marker or peg merely placed in such indentation in a loose arrangement, i.e., without inserting the peg into a hole or other retaining means.

Referring again to FIG. 3, one can see that the marker member 174 is formed by six sides, side 178, 180, 182, 184, 186 and 188 respectively. Thus, the marker member 174 can move in any one of six specific directions to the degree indicated by the indicator 176 in the side of the marker member in the forefront of the move. Upon impinging upon a boundary the member 174 would then be able to travel at an acute angle with respect to its initial line of travel or stop. Assume that side 178 impinged upon section 190. If marker member 174 had additional force left, one could rotate marker member 174 such that side 178 was at the forefront of the new direction of travel if the marker member 174 warped at that point. If it concludes its move on that space, it may only rotate if qualified by optional rotation discussed hereinabove.

In connection with either embodiment, the marker member can be identified by color, name or the like such that each player can readily identify his markers.

It is to be understood, however, that while the above noted description of the first and second embodiments are made so that one can gain a feeling for this invention, other embodiments are also within the scope of the present invention. This invention, therefore, is not to be limited to the specific embodiments hereinabove discussed.

What is claimed is:

1. A board game comprising:

(a) a gameboard having disposed thereon a playing field including a generally square area of individual spaces forming said playing field, said spaces forming increments of travel;

(b) a plurality of sets of marker members each set having identification means for identifying the marker members of that set belonging to a particular player, each said marker member having eight sides with indicators disposed adjacent each said side for indicating the number of spaces said marker member may move in a predetermined direction and wherein said identification means comprise a series of indentations adjacent each said side and a predetermined number of indicator members disposed in said indentations; and (c) means operable by each player for identifying the space upon which each of said marker members for each said set is placed at the inception of the game.

2. A game according to claim 1 wherein each said space includes means for identifying said space.

3. A game according to claim 1 wherein said board has a plurality of playing fields comprised of spaces in various quantities.

4. A game according to claim 1 wherein said board includes boundary means surrounding each said space for preventing accidental movement or rotation of said marker members.

* * * * *